US010165630B2

(12) United States Patent
Okoniewski et al.

(10) Patent No.: US 10,165,630 B2
(45) Date of Patent: Dec. 25, 2018

(54) TRAVELING WAVE ANTENNA FOR ELECTROMAGNETIC HEATING

(71) Applicant: Acceleware Ltd., Calgary (CA)

(72) Inventors: Michal M. Okoniewski, Calgary (CA); Damir Pasalic, Calgary (CA)

(73) Assignee: ACCELEWARE LTD., Calgary, Alberta (CA)

( * ) Notice: Subject to any disclaimer, the term of this patent is extended or adjusted under 35 U.S.C. 154(b) by 303 days.

(21) Appl. No.: 15/016,785

(22) Filed: Feb. 5, 2016

(65) Prior Publication Data

US 2017/0231035 A1 Aug. 10, 2017

(51) Int. Cl.
*H05B 6/70* (2006.01)
*H05B 6/72* (2006.01)
(Continued)

(52) U.S. Cl.
CPC ..... *H05B 6/72* (2013.01); *E21B 43/2401* (2013.01); *H01Q 1/362* (2013.01); *H01Q 13/103* (2013.01); *H01Q 13/12* (2013.01); *H01Q 21/0043* (2013.01); *H05B 6/708* (2013.01); *H05B 6/802* (2013.01)

(58) Field of Classification Search
CPC ..... H05B 6/52; H05B 6/708; H05B 6/72; H05B 6/80; H05B 6/802; H01Q 13/085; H01Q 13/10; H01Q 13/103; H01Q 13/12; H01Q 13/203; H01Q 13/362; H01Q 1/04; H01Q 1/1271; H01Q 1/246; H01Q 1/362; H01Q 1/38; H01Q 21/0043; H01Q 21/24;
(Continued)

(56) References Cited

U.S. PATENT DOCUMENTS 4,490,727 A 12/1984 Kowols
7,182,151 B2 * 2/2007 Stump ..... E21B 7/046 166/254.1
(Continued)

FOREIGN PATENT DOCUMENTS

CA 2895595 A1 12/2015

OTHER PUBLICATIONS

Mario Pauli et al., "Impedance Matching of a Coaxial Antenna for Microwave In-situ Processing of Polluted Soils", retrieved from Journal of Microwave Power and Electromagnetic Energy, 45 (2), 2011, pp. 70-78.
International Search Report and Written Opinion dated May 10, 2017 in corresponding International Patent Application No. PCT/CA2017/050104.

*Primary Examiner* — Hung D Nguyen
(74) *Attorney, Agent, or Firm* — Dickinson Wright PLLC

(57) ABSTRACT

A radio frequency antenna for radiating electromagnetic energy into a reservoir filled with a target material, the antenna being operatively connected to a feed transmission line. The antenna includes a waveguide, at least one slot formed in the outer waveguide layer, and a sleeve portion enclosing at least a portion of the waveguide. The sleeve portion comprises at least first and second dielectric layers where the permittivity of the second dielectric layer is higher than the permittivity of the first dielectric layer and the first dielectric layer is positioned in closer proximity to the waveguide than the second dielectric layer. When the antenna is inserted into the reservoir, the input impedance of the antenna remains matched to the feed transmission line for a wide range of target materials.

31 Claims, 11 Drawing Sheets

(51) Int. Cl.

| | |
|---|---|
| ***E21B 43/24*** | (2006.01) |
| ***H01Q 1/36*** | (2006.01) |
| ***H01Q 13/10*** | (2006.01) |
| ***H01Q 13/12*** | (2006.01) |
| ***H01Q 21/00*** | (2006.01) |
| ***H05B 6/80*** | (2006.01) |

(58) Field of Classification Search

CPC ..... E21B 43/2401; E21B 43/2408; E21B 43/2406

USPC ..... 219/687, 690–697; 166/60, 248, 254.1, 166/255.1, 255.2, 268, 270.1; 343/713, 343/719, 750, 767, 772, 785, 793, 795, 343/803, 810, 834, 850, 859

See application file for complete search history.

(56) References Cited

U.S. PATENT DOCUMENTS

| | | | | |
|---|---|---|---|---|
| 7,194,297 | B2 | 3/2007 | Talpade et al. | |
| 2008/0073079 | A1* | 3/2008 | Tranquilla ..... | E21B 43/003 166/270.1 |
| 2014/0110395 | A1* | 4/2014 | Parsche ..... | E21B 43/2401 219/481 |
| 2014/0266951 | A1 | 9/2014 | Okoniewski et al. | |
| 2015/0322759 | A1* | 11/2015 | Okoniewski ..... | H01Q 1/04 166/60 |

* cited by examiner

Section BB

Section A'A'

Example embodiment with 3 dielectric layers in the dielectric sleeve

TRAVELING WAVE ANTENNA FOR ELECTROMAGNETIC HEATING

FIELD

The embodiments described herein relate to radio frequency antenna for radiating electromagnetic energy into a reservoir filled with a target material such as hydrocarbons.

BACKGROUND OF THE INVENTION

Radio-frequency (RF) antennas may be used in various applications where it is desired to radiate electromagnetic (EM) energy into a reservoir filled with a target material in order to change one or more of the target material's characteristics. For example, radiation of EM energy may initiate or enhance a chemical process or reaction, heat the target material, or help to perform an analysis of the target material's physical properties or composition. EM radiation may be used at different stages of oil production: heating the soil to decrease viscosity of oil, improve oil's mobility, or upgrade the bitumen or heavy oil in a process on the surface or underground.

The RF antenna and its environment form a connected system, and the RF antenna's performance greatly depends on the EM properties of the surrounding target material. The input impedance of the RF antenna characterizes its ability to deliver high RF power to the target material. The RF antenna is a part of an electrical circuit that typically comprises an RF generator, impedance matching circuits, and a feed transmission line. If there is a mismatch between the RF antenna's input impedance and its feed system, at least one part of the EM power will be reflected from the antenna back to the RF generator. This EM power reflection reduces the amount of power delivered by the RF antenna to the target material in the reservoir and increases losses and/or heating in the transmission line and the RF generator. This typically leads to a decrease in the overall system efficiency.

To reduce or eliminate the EM power reflection, impedance matching circuits are generally used between the RF antenna and the RF generator. The matching circuits tend to be expensive and complex and typically operate optimally only within a narrow frequency range. Instead, dynamic or adaptive impedance matching circuits that match the antenna to the feed transmission line over a wider range of frequencies and/or values of input impedance, may be used. However, the cost and complexity of such dynamic matching circuits is significantly higher than that of the regular matching circuits.

It would be desirable to reduce the EM power reflection from the RF antenna delivering the RF power into surrounding target material by improving the impedance matching between the RF antenna and the feed transmission line without the use of an impedance matching circuit.

SUMMARY

In a first aspect, there is provided a radio frequency antenna for radiating electromagnetic energy into a reservoir filled with a target material, the antenna being operatively connected to a feed transmission line. In at least one embodiment, the antenna may include a waveguide having an inner waveguide layer a waveguide dielectric layer, and an outer waveguide layer; at least one slot formed in the outer waveguide layer, the at least one slot being adapted to radiate the electro-magnetic energy into the reservoir; and a sleeve portion enclosing at least a portion of the waveguide, the sleeve portion having at least first and second dielectric layers where the permittivity of the second dielectric layer is higher than the permittivity of the first dielectric layer and the first dielectric layer is positioned in closer proximity to the waveguide than the second dielectric layer; such that when the antenna is inserted into the reservoir, the input impedance of the antenna remains matched to the feed transmission line for a wide range of target materials.

In at least one embodiment, the at least one slot and at least one of the first and second dielectric layers may be dimensioned and positioned relative to each other such that the reflectivity coefficient of the antenna may be less than approximately −10 dB.

In at least one embodiment, at least one of the first and second dielectric layers may have permittivity and thickness such that the reflectivity coefficient of the antenna may be less than approximately −10 dB.

In at least one embodiment, the thickness of at least one of the first and second dielectric layers may be equal to a thickness factor multiplied by the wavelength of the electromagnetic wave in the waveguide dielectric layer, the thickness factor being in the approximate range of 1/15 to 1/4.

In at least one embodiment, the thickness of at least one of the first and second dielectric layers may be equal to a thickness factor multiplied by the wavelength of the electromagnetic wave in the waveguide dielectric layer, the thickness factor being in the approximate range of 1/30 to 1. In at least one embodiment, the radius of the at least first and second dielectric layers may be variable along the length of the antenna.

In at least one embodiment, a most inner dielectric layer of the sleeve portion may be air. In at least one embodiment, at least one of the at least first and second dielectric layers may be made at least in part of ceramic material. In at least one embodiment, at least one of the at least first and second dielectric layers may be concentric.

In at least one embodiment, the at least one slot may have helical form. In at least one embodiment, a plurality of slots may be formed in the outer waveguide layer. In at least one embodiment, the slots may be formed along the waveguide with dimensions and relative distribution such that uniform near-field radiation may be provided along the length of the antenna.

In at least one embodiment, each of the plurality of slots may be formed with identical dimensions. In at least one embodiment, each of the plurality of slots may have identical shapes. In at least one embodiment, the slots may be equally distributed along the length of the waveguide. In at least one embodiment, the slots may be unequally distributed along the length of the waveguide. In at least one embodiment, at least one of the first and second dielectric layers may be concentric.

In at least one embodiment, the waveguide may have an input portion operatively connected to the feed transmission line and an output portion connected to a termination.

In at least one embodiment, the slots that are in closer proximity to the input portion of the waveguide may have smaller dimensions and may be positioned farther apart than slots that are in closer proximity to the output portion of the waveguide.

In at least one embodiment, the antenna may be adapted to operate: (a) in a resonant mode when a permittivity ratio is less than or about 1 and (b) in a travelling wave mode when the permittivity ratio is more than about 1, wherein the permittivity ratio is the ratio of a permittivity of the target material in the reservoir to the permittivity of the waveguide dielectric layer.

In at least one embodiment, the waveguide may be of the type selected from the group consisting of: a coaxial waveguide, a hollow cylindrical waveguide and a rectangular waveguide.

In at least one embodiment, the lateral dimension of the waveguide may be approximately equal to the lateral dimension of the feed transmission line. In at least one embodiment, the feed transmission line and the waveguide may be both coaxial cables.

In at least one embodiment, the antenna may be adapted to operate at a center frequency of about 30 MHz to about 10 GHz.

In at least one embodiment, the waveguide dielectric layer may be air.

In at least one embodiment, the antenna may comprise a plurality of segments.

In at least one embodiment, the termination of the radio-frequency antenna may be selected from the group consisting of: a short termination, an open termination, and a matched termination. In at least one embodiment, the radio-frequency antenna may further comprise a connecting transmission line operatively connected between the antenna and the feed transmission line.

In at least one embodiment, the target material in the reservoir may be selected from the group consisting of: air, dry oil sand, wet oil sand, water, soil, soil sands, shale, ore, and a combination thereof.

In at least one embodiment, the target material in the reservoir may have a relative dielectric permittivity about 1 to about 90 and electric conductivity about 0 S/m to about 5 S/m.

In at least one embodiment, at least one portion of the antenna may be inserted into the reservoir or at least one portion of the antenna may be outside of the reservoir.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1A:
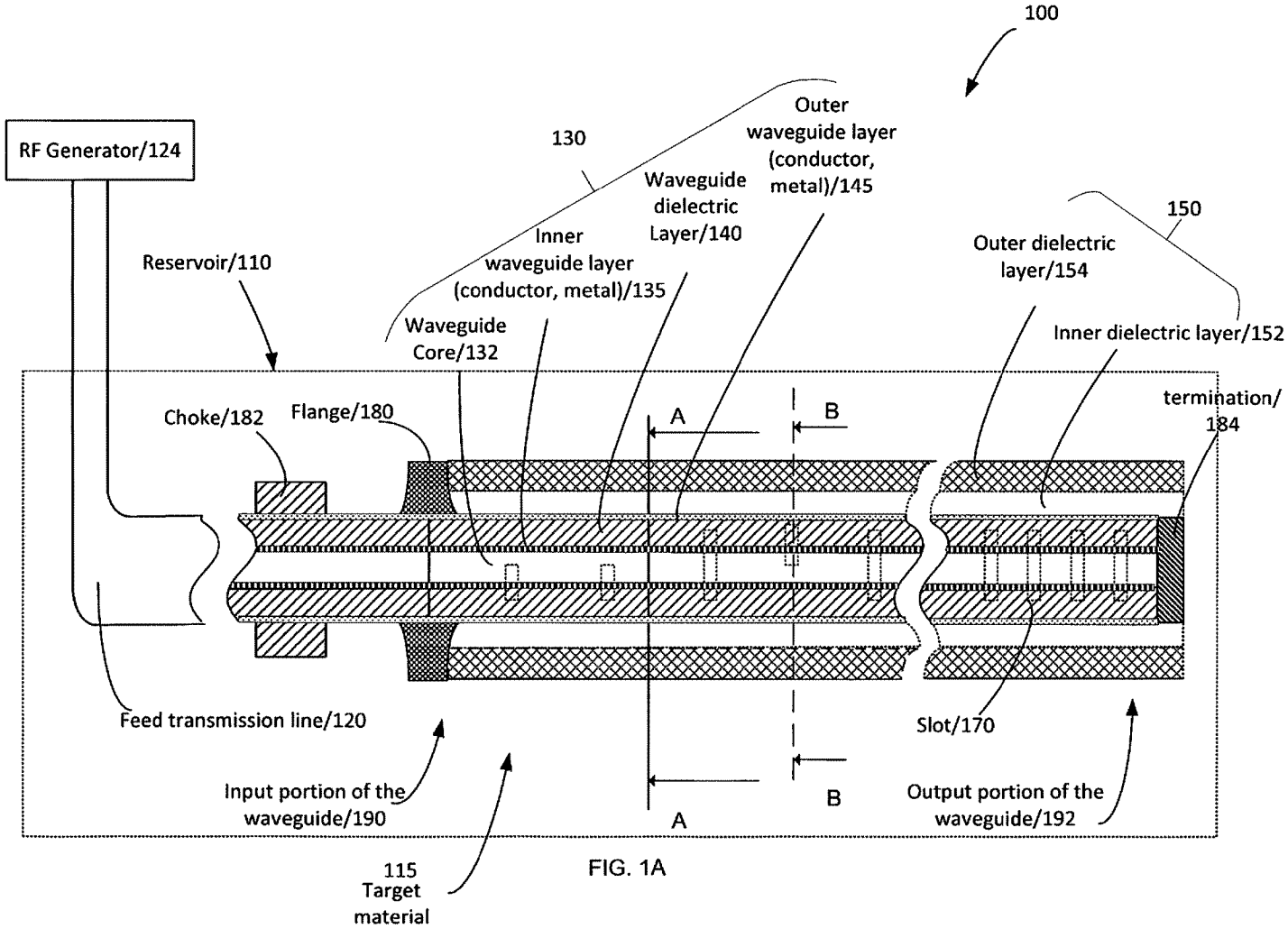
FIG. 1A is a cross-sectional side view of a radio frequency antenna for radiating electromagnetic energy when inserted into a reservoir filled with a target material, the antenna being operatively connected to a feed transmission line, in accordance with at least one embodiment.

The skilled person in the art will understand that the drawings, described below, are for illustration purposes only. The drawings are not intended to limit the scope of the applicants' teachings in anyway. Also, it will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures it should be understood that such features are not limited to usage in the one or more particular embodiments or FIGS. with reference to which they are described.

The terms "an embodiment", "embodiment", "embodiments", "the embodiment", "the embodiments", "one or more embodiments", "some embodiments", and "one embodiment" mean "one or more (but not all) embodiments of the present invention(s)", unless expressly specified otherwise.

The terms "including", "comprising" and variations thereof mean "including but not limited to", unless expressly specified otherwise. A listing of items does not imply that any or all of the items are mutually exclusive, unless expressly specified otherwise. The terms "a", "an" and "the" mean "one or more", unless expressly specified otherwise.

Further, although process steps, method steps, algorithms or the like may be described (in the disclosure and/or in the claims) in a sequential order, such processes, methods and algorithms may be configured to work in alternate orders. In other words, any sequence or order of steps that may be described does not necessarily indicate a requirement that the steps be performed in that order. The steps of processes described herein may be performed in any order that is practical. Further, some steps may be performed simultaneously.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

Furthermore, the recitation of any numerical ranges by end points herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation up to a certain amount of the number to which reference is being made if the end result is not significantly changed.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

Figure 1B:
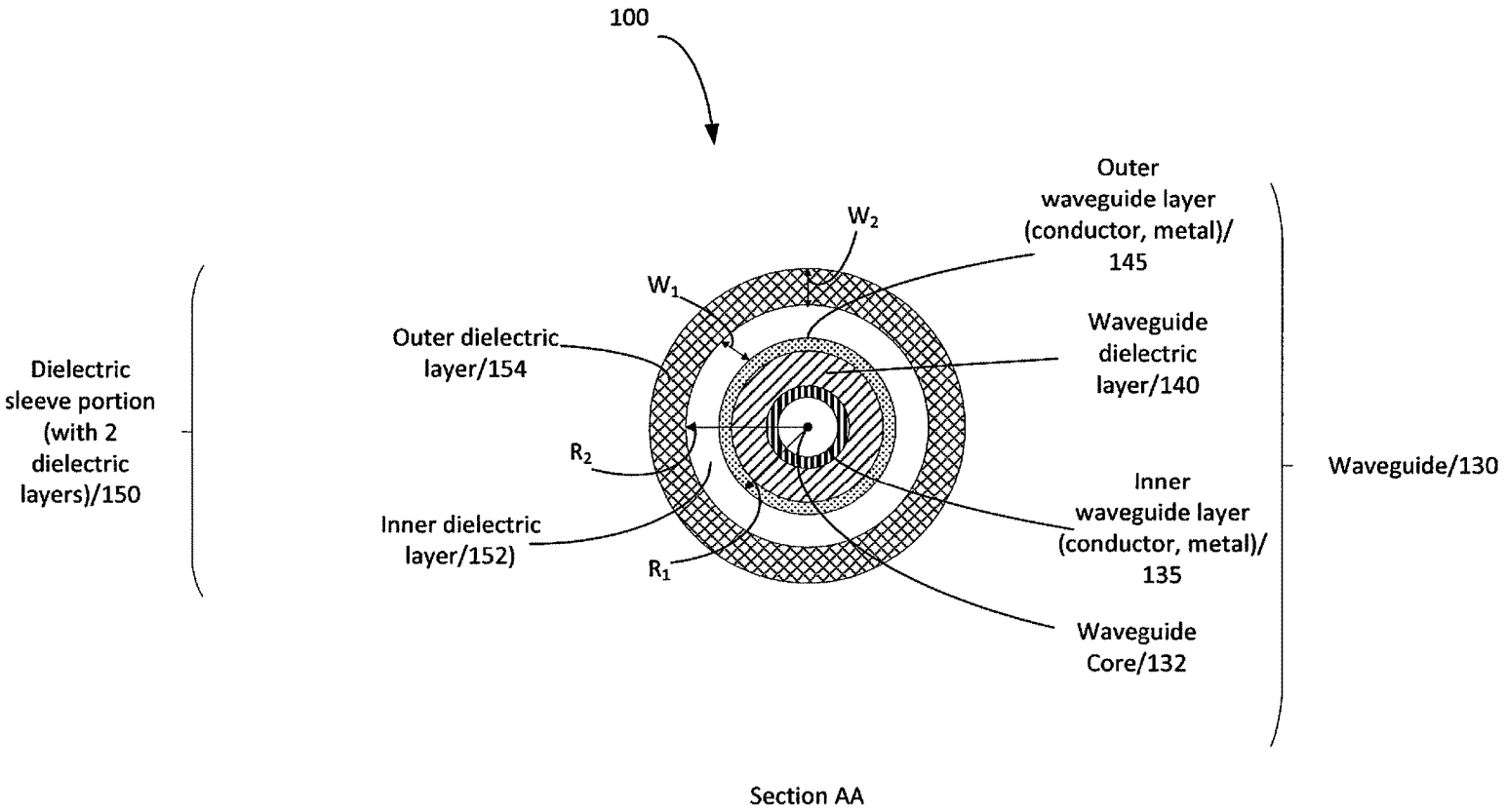
FIG. 1B is a cross-section of the RF antenna taken along the line A-A of FIG. 1A.
Figure 1C:
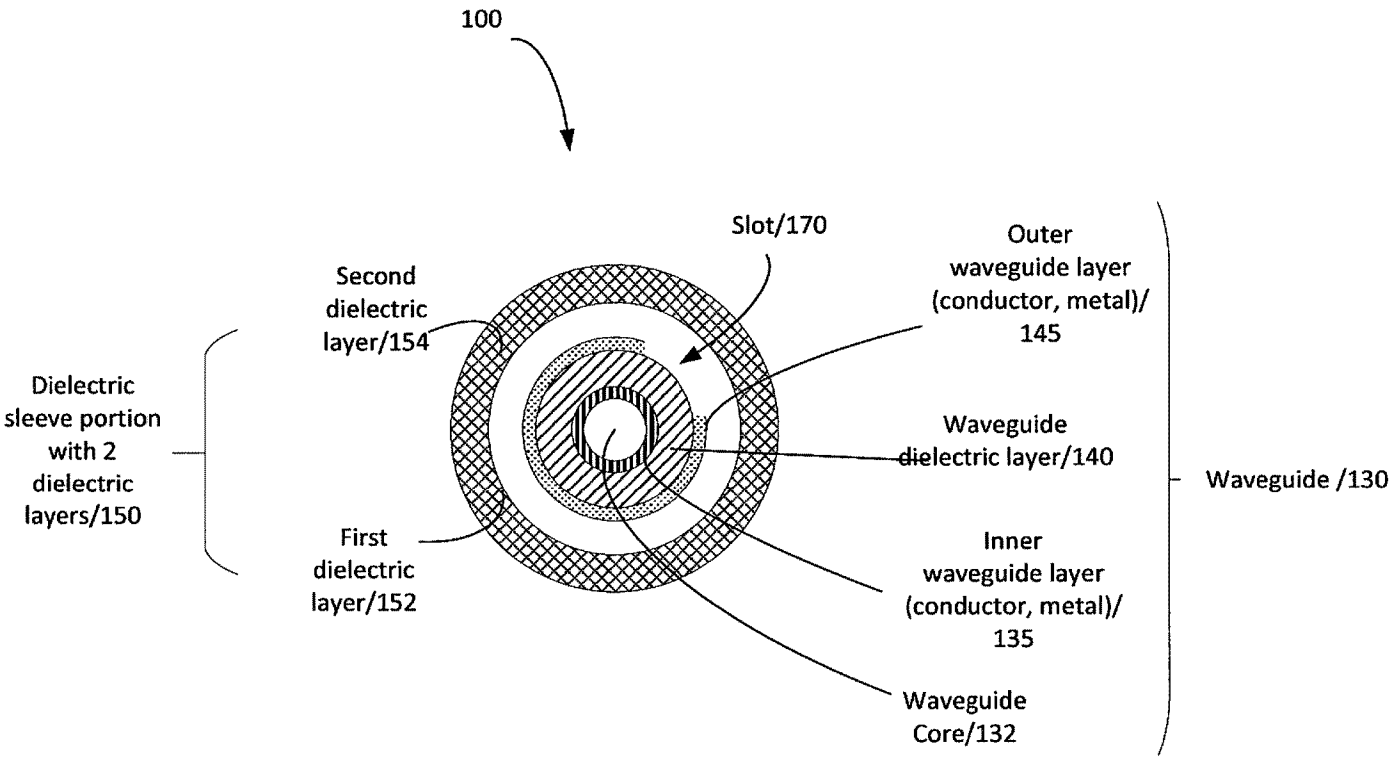
FIG. 1C is a cross-section of the RF antenna taken along the line B-B of FIG. 1A.

FIGS. 1A, 1B, and 1C show schematic views of a radio frequency antenna 100 for radiating electromagnetic energy into a reservoir 110 filled with a target material 115, in accordance with at least one embodiment.

FIG. 1A shows a cross-sectional side view of the antenna 100. FIG. 1B is a cross-sectional view taken along the line A-A of FIG. 1A. FIG. 1C shows a cross-sectional view taken along the line B-B of FIG. 1A. In at least one embodiment, the antenna 100 comprises a waveguide 130, at least one slot 170, and a sleeve portion 150.

The antenna 100 may be designed to be operatively connected to a feed transmission line 120. In at least one embodiment, the input portion 190 of the waveguide 130 of the antenna 100 may be operatively connected to the feed transmission line 120. In this way the feed transmission line 120 may deliver RF power from an RF generator 124 to the antenna 100.

In at least one embodiment, at least a portion of the antenna 100 may be positioned within the reservoir 110 (i.e. after being inserted into the reservoir 110). In at least one embodiment, at least a portion of the antenna 100 may be positioned outside the reservoir 110. In at least one embodiment, the antenna 100 may be at a certain distance from the reservoir 110.

For example, the target material 115 may be enclosed in a holder made of EM transparent material (such as, e.g. ceramic). The antenna 100 may be placed close to such reservoir 110, or even touching its surface. In this case, the antenna 110 may radiate a portion of its energy into the reservoir 110.

In at least one embodiment, the target material 115 in the reservoir 110 may include materials such as air, dry oil sand, wet oil sand, water, soil, soil sands, other industrial material, shale, ore, brine, clay, drilling mud, crude oil or a geologic formation containing oil, heavy oil, bitumen, other hydrocarbons, and/or a combination thereof.

For example, the target material 115 in the reservoir 110 may have a relative dielectric permittivity of about 1 to about 90; about 1.5 to about 90; about 2 to about 80; about 2 to about 60; about 2 to about 70; about 2 to about 57; about 2 to about 50; of about 50 to about 60; of about 10 to about 60.

For example, the target material 115 in the reservoir 110 may have a relative dielectric permittivity of at least about 1.5; at least about 2; at least about 10; at least about 30; at least about 50; not greater than about 60; not greater than about 70; not greater than about 80; not greater than about 90; not greater than about 58.

For example, the target material 115 in the reservoir 110 may be lossy (i.e. the electromagnetic field may be absorbed by the target material 115). For example, the target material 115 in the reservoir 110 may have conductivity of about 0 S/m to about 5 S/m. For example, the target material 115 in the reservoir 110 may have conductivity of about 0 S/m to about 1 S/m; of about 0 S/m to about 4 S/m; of about 1 S/m to about 4 S/m; of about 0 S/m to about 3 S/m. For example, the conductivity of the dry sand may be about 2.5 E−5 S/m, wet oil sand material may have conductivity of about 0.01 S/m, or about 0.002 S/m, or about 0.005 S/m (depending on the amount of water).

The reservoir 110 may be a container (e.g. a metal container), or a reactor, directly interacting with the target material 115. Alternatively, the reservoir 110 does not have to have walls, rather it could be partially comprised of surrounding materials such as a soil, etc. surrounding the target material 115.

In at least one embodiment, the waveguide 130 may be of a type of a coaxial cable, a hollow waveguide, a cylindrical waveguide, or a rectangular waveguide. For example, the waveguide 130 may have any type of cross-section, including, but not limited to cylindrical, rectangular, or elliptical.

For example, the waveguide 130 may be of the same type and/or have the same at least one cross-sectional dimension as the transmission line 120. In at least one embodiment, the widest dimension of the cross-section of the waveguide 130 may be approximately equal to the widest dimension of the feed transmission line 120. In at least one embodiment, both the waveguide 130 and the feed transmission line 120 may be coaxial cables.

In at least one embodiment, the waveguide 130 may comprise a waveguide core 132, an inner waveguide layer 135, a waveguide dielectric layer 140, and an outer waveguide layer 145.

As shown at FIG. 1B, the inner waveguide layer 135 may at least partially enclose the waveguide core 132. The waveguide dielectric layer 140 may at least partially enclose the inner waveguide layer 135. The outer waveguide layer 145 may at least partially enclose the waveguide dielectric layer 140. The inner waveguide layer 135 is positioned closer to the waveguide core 132 than the outer waveguide layer 145.

In at least one embodiment, the waveguide 130 may also comprise other waveguide layers. For example, the waveguide 130 may comprise a plurality of waveguide dielectric layers made of the same or different dielectric materials. The waveguide 130 may also comprise other layers made of at least one type of a conductor. Each of the plurality of waveguide layers may at least partially enclose one or more other waveguide layers. It should be understood that different dielectric materials may be used both in longitudinal and radial directions.

The waveguide core 132 may be made of air and/or a dielectric material. For example, the waveguide core 132 may have relative permittivity of about 1 to about 30. It should be noted that the relative permittivity is defined herein as a ratio of the permittivity of a certain material to the permittivity of vacuum. For example, the waveguide core 132 may be made of liquid (e.g. for cooling purpose), and/or other gas, and/or solid.

The inner waveguide layer 135 may be made of a first conductor. The first conductor may be a metal, such as, for example: copper, aluminum, steel. For example, the inner waveguide layer 135 may have conductivity of $10^6$ S/m to about $6\times10^7$ S/m.

For example, the outer waveguide layer 145 may be made of a second conductor. For example, the second conductor may be: copper, aluminum, steel. For example, the outer waveguide layer 145 may have conductivity of $10^6$ S/m to about $6\times10^7$ S/m.

For example, the waveguide dielectric layer 140 may be made of air and/or a dielectric material such as, for example, fiberglass, PEEK, teflon, different types of ceramic (e.g.: Alumina, Zirconia), hydrocarbon liquid (e.g.: toluene, saraline, benzene, etc.). For example, the waveguide dielectric layer 140 may have relative permittivity of about 2 to about 40. For example, the waveguide dielectric layer 140 may have relative permittivity of at least about 1.5; at least about 2; at least about 10, at least about 20; at least about 30; not greater than about 40; not greater than about 50; not greater than about 60; and not greater than about 80.

The waveguide 130 may be adapted to receive EM energy (RF power) from the transmission line 120 and to transmit it from the input portion of the waveguide 190 to the output portion of the waveguide 192.

In at least one embodiment, the waveguide 130 (and the antenna 100) may be longer than at least two wavelengths $\lambda$ of the EM wave in the waveguide 130, where, for example, the wavelength $\lambda$ is calculated in the waveguide dielectric layer 140.

In at least one embodiment, the at least one slot 170 may be formed in the waveguide 130 of the antenna 100. In at least one embodiment, the at least one slot 170 may be formed in the outer waveguide layer 145, as shown in FIG. 1C. In at least one embodiment, the at least one slot 170 may be adapted to radiate the EM energy from the waveguide 130 into the reservoir 110.

For example, the slots 170 may be located at any portion of the outer waveguide layer 145, such as sidewalls and/or top walls and/or bottom walls of the waveguide 130.

In at least one embodiment, the outer waveguide layer 145 may comprise a plurality of slots 170. For example, each of the plurality of slots 170 may be formed with identical dimensions and/or identical shapes.

Figure 3:
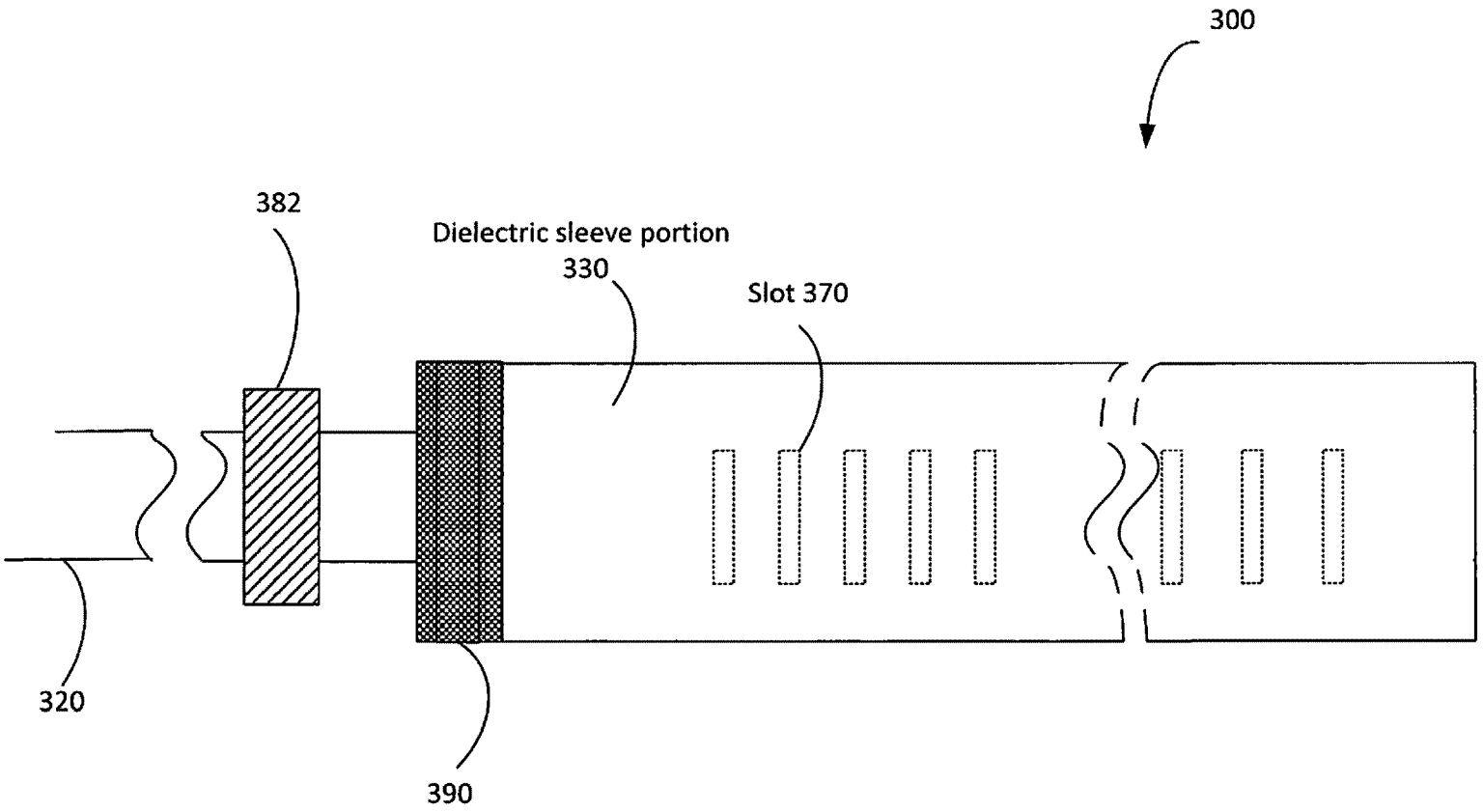
FIG. 3 is a schematic view of the RF antenna for radiating electromagnetic energy when inserted into the reservoir filled with the target material, in accordance with at least one embodiment.

FIG. 3 shows a further example embodiment of the antenna 300 where slots 370 are formed with identical dimensions, in accordance with at least one embodiment.

Referring again to FIG. 1A, in at least one embodiment, at least one slot 170 may have a dimension and/or shape different from dimensions and/or shapes of at least one other slot 170. For example, the dimensions and/or shapes of slots 170 may vary along the length of the antenna 100.

In at least one embodiment, at least three of the slots 170 may be equally and/or unequally distributed along the length of the waveguide 130. For example, the slots 170 may be distributed equally at one portion of the waveguide 130 and may be distributed unequally at another portion of the waveguide 130.

In at least one embodiment, the slots 170 may be distributed uniformly with a certain distance between each other, or with a varying distance between each other.

For example, some portions of the antenna 100 may have the density of slots 170 higher than the other portions in order to radiate more EM energy. For example, increasing the distance between the slots 170 (decreasing the density of the slots 170) in one portion of the waveguide 130 may decrease the EM radiation from the waveguide 130 (and therefore in the corresponding portion of the antenna 100). Decreasing the distance between the slots 170 in one portion of the waveguide 130 (increasing the density of slots 170) increases the EM radiation in that portion of the waveguide 130 (and therefore in the corresponding portion of the antenna 100).

It should be understood that the input portion 190 of the waveguide 130, which is operatively connected to the feed transmission line 120, may have more RF power than the output portion 192 of the waveguide 130, which is operatively connected to a termination 184.

The antenna 100 is said to operate in a "slow mode" when the phase velocity of the wave present inside the antenna 100 is lower than the phase velocity of the wave that is radiated into the reservoir's target material 115. When the antenna 100 operates in a "slow mode", slots 170 may be positioned periodically, with the periodic distance determining a frequency range in which the radiation is possible. For example, the m-th harmonic may radiate in the frequency range between −m11 and −m*f2, where $f1=c/(P*(\mathrm{sqrt}(e_r)+1))$ and $f2=c/(P*(\mathrm{sqrt}(e_r)-1))$, where P is the periodic distance, c is the velocity of light in vacuum, $e_r$ is the relative permittivity of the dielectric inside the antenna 100 or effective relative permittivity of the multiple dielectrics inside the antenna 100.

In at least one embodiment, there may be a few sections with different periods, but within each section the period may be constant. It should be noted that slow or fast wave refers to slow or fast wave phase velocity, as it compares with the phase velocity of the wave radiated out.

The antenna 100 is said to operate in a "fast mode" when the wave present inside the antenna 100 is higher than the speed of the wave outside the antenna 100. When the antenna 100 operates in a fast mode, any type of slot distribution and/or density of slots 170 may be used.

In at least one embodiment, each or at least one portion of the waveguide 130, with the portion's length approximately equal to about a wavelength $\lambda$, of the EM wave in the waveguide 130, may contain at least two slots 170. For example, if the wavelength $\lambda$=1 m, there may be at least two slots 170 positioned every meter along the waveguide 130.

In at least one embodiment, the slots 170 of the antenna 100 may be designed such that about all or at least 90% of the RF energy may be radiated into the reservoir 110 by the time the RF energy reaches the output portion 192 of the antenna 100.

In at least one embodiment, each slot 170 may be designed with small enough dimensions such that it radiates only a small portion of the RF energy into the target material 115, and therefore does not cause a noticeable disturbance of the EM wave inside the waveguide 130. This may permit the antenna to maintain properties (for example, characteristic impedance) that are close to the properties of the feed transmission line 120, and accordingly assist with maintaining impedance matching of the antenna 100 with the feed transmission line 120.

For example, each slot 170 may have width lower than or about $\lambda/20$, where $\lambda$ is the wavelength of the EM wave inside the waveguide. For example, when the antenna 100 has a plurality of slots 170, the length of each slot 170 may be about $\lambda/20$ to about $\lambda/2$.

For example, the distance between the slots may be about λ/20 to about λ. Generally, the wider, longer or more frequent slots 170 are, the more energy may be radiated by them. Density, length and width of the slots 170, as well as their tilt angle may be adjusted to achieve desired radiation pattern and to make sure that most of the EM power is radiated by the time the EM wave reaches the output portion of the antenna 100.

For example, the length of the slot 170 may be about as long as the antenna 100 (e.g. a horizontal slot). The length of this type of slot 170 may be about multiple wavelengths of the EM wave inside the waveguide. For example, the length of the slot 170 may be longer than the length of the antenna 100, when e.g. the slot 170 is helical.

Further, different shapes, dimensions and relative distribution of slots 170 may help to achieve a specific radiation profile of the EM wave in the reservoir 110. In at least one embodiment, the slots 170 may be formed along the waveguide 130 with dimensions, and/or shapes, and/or relative distribution such that uniform near-field radiation may be achieved along the length of the antenna 100. For example, specific combination of shapes, and/or dimensions, and/or relative distribution may help to achieve high power concentration at a certain distance from the waveguide 130.

In at least one embodiment, the input portion 190 of the waveguide 130 may be designed to have fewer slots 170 than in the output portion 192 of the waveguide 130. In at least one embodiment, the density of slots at the input portion 190 of the waveguide 130 may be lower than the density of slots 170 at the output portion 192 of the waveguide 130.

In at least one embodiment, the input portion 190 of the waveguide 130 may have less slots 170 and/or smaller slots, while the output portion 192 of the waveguide 192 may have more slots 170 and/or the slots may have higher density and/or larger sizes.

In at least one embodiment, the slots 170 that are in closer proximity to the input portion 190 of the waveguide 190 may have smaller dimensions and/or may be positioned farther apart than slots 170 that are in closer proximity to the output portion 192 of the waveguide 130.

In at least one embodiment, the slots 170 may be distributed along the waveguide 130 such that the electromagnetic energy provided at the output portion 192 of the waveguide 130 may be at least about 10 times lower than the electromagnetic energy provided at the input portion 190 of the waveguide 130.

In at least one embodiment, the at least one slot 170 may be vertical and/or horizontal.

Figure 4:
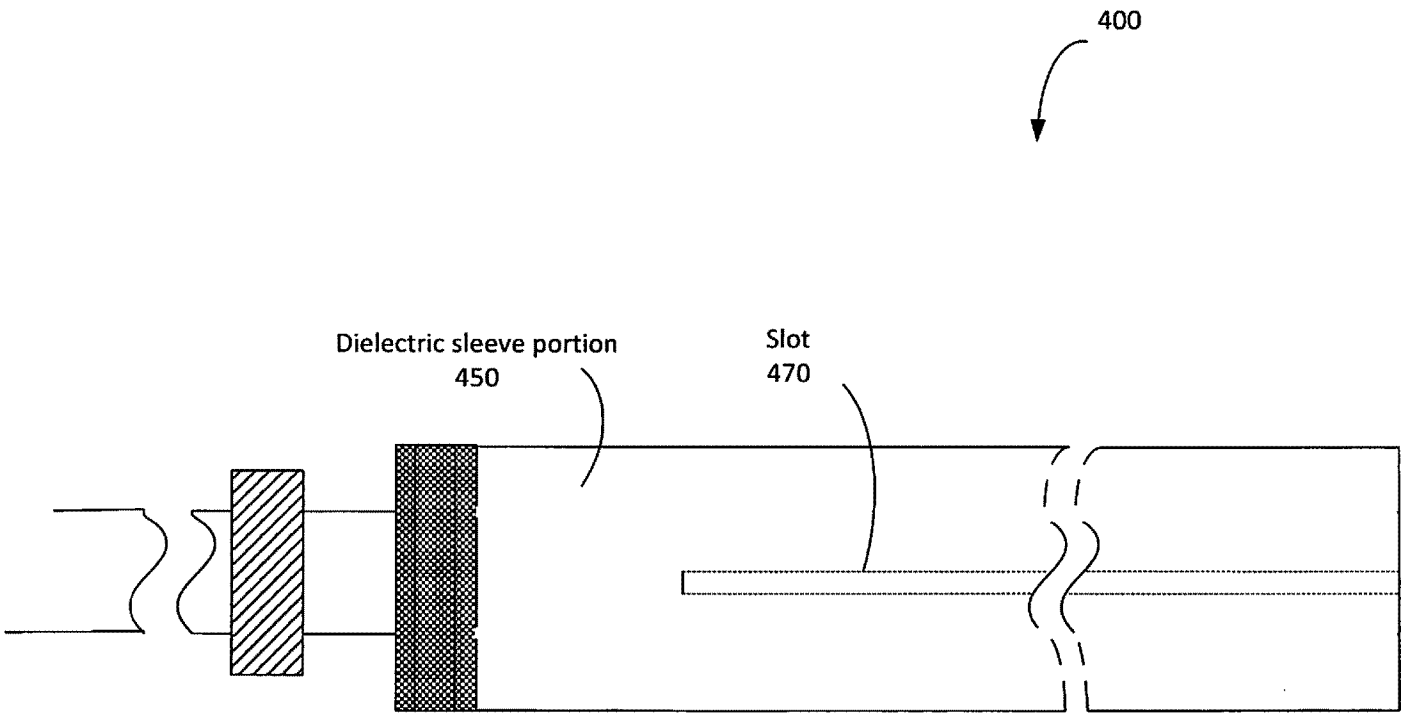
FIG. 4 is a schematic view of the RF antenna for radiating electromagnetic energy when inserted into the reservoir filled with the target material, in accordance with at least one embodiment.

FIG. 4 illustrates an exemplary embodiment of the radio-frequency antenna 400 having one slot 470 in horizontal (longitudinal) direction. This type of slot 470 may be used when the current direction in the waveguide is circular, around the waveguide 130 (i.e. in vertical direction in FIG. 4). The width of the slot 470 may be adjusted along its length to allow shaping of the radiation pattern. For example, wider sections of the slot 470 may radiate more power than the narrower. For example, the slot 470 may be longer than about λ/10. For example, the slot 470 may be about as long as the waveguide 130.

Figure 5:
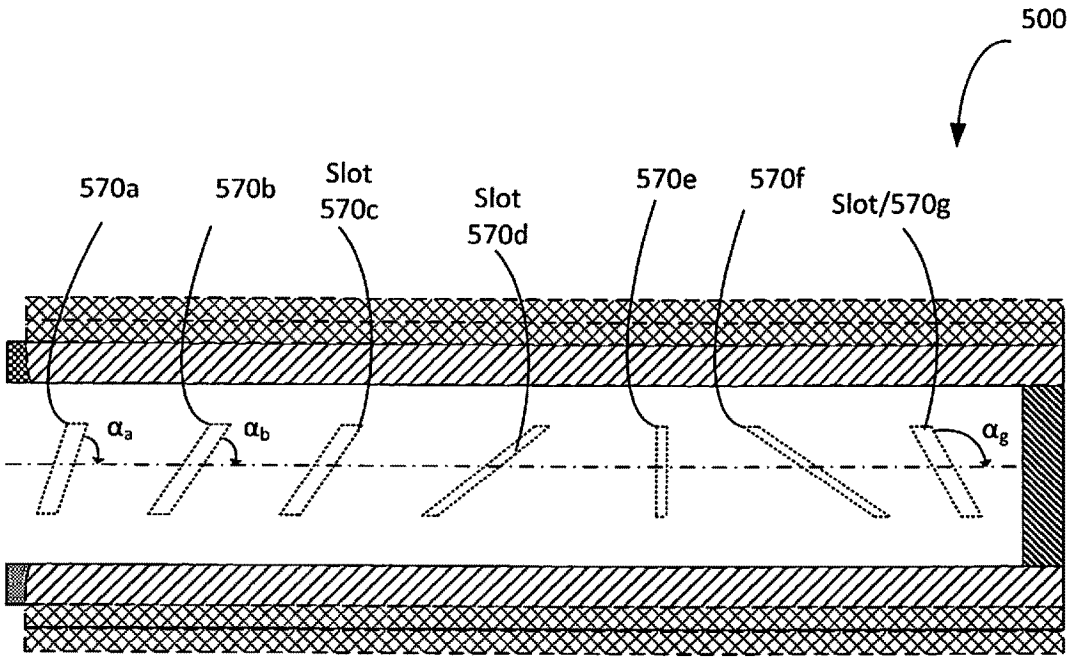
FIG. 5 is a schematic view of the RF antenna for radiating electromagnetic energy when inserted into the reservoir filled with the target material, in accordance with at least one embodiment.

FIG. 5 is another exemplary embodiment of the antenna 500 where the orientation of the slots is tilted at an angle with respect to the longitudinal axis. Specifically, a vertical slot 570*e* and tilted slots 570*a*, 570*b*, 570*c*, 570*d*, 570*f*, and 570*g* are illustrated. For example, the tilt angle $\alpha_a$, $\alpha_b$, . . . of the slots 570 may be about 0 to about π. For example, if the current direction is longitudinal, the largest radiation may be achieved by the vertical slot 570*e*. Tilting the slot by a certain angle and keeping its total length constant can decrease radiation by that slot.

Figure 6:
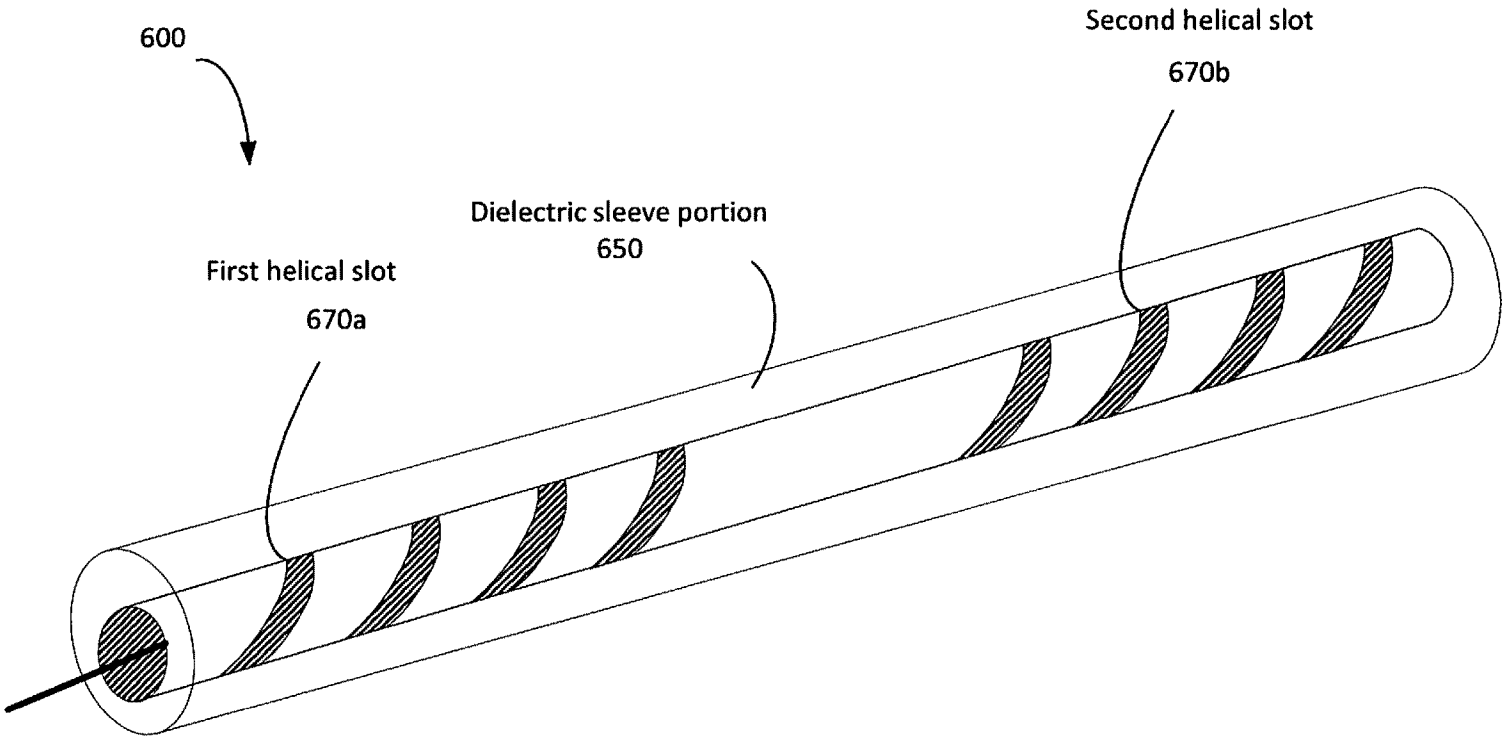
FIG. 6 is a schematic view of the RF antenna for radiating electromagnetic energy when inserted into the reservoir filled with the target material, in accordance with at least one embodiment.

FIG. 6 is another exemplary embodiment of the antenna 600 where at least one slot 670*a* (or 670*b*) has helical form. For example, the at least one slot 670*a* (or 670*b*) may have one or several turns around the waveguide 130. For example, when the at least one slot 670*a* (or 670*b*) has helical form, the length of the slot 670*a* (or 670*b*) may be longer than the circumference of the waveguide 130. For example, the helical slot 670*a* (or 670*b*) may be used when the diameter of the waveguide 130 is smaller than λ/20, making a single vertical slot too small to radiate any meaningful amount of EM energy. Generally, a longer helical slot, i.e. the slot with more turns may radiate more EM energy into the target material 115.

In at least one embodiment, the sleeve portion 150 of the antenna 100 may enclose at least one portion of the waveguide 130. For example, as shown in FIG. 1A, the sleeve portion 150 may be positioned between the input portion 190 of the waveguide 130 and the output portion 192 of the waveguide 130.

In at least one embodiment, the sleeve portion 150 may comprise two or more dielectric layers. In at least one embodiment, the sleeve portion 150 may comprise an inner (first) dielectric layer 152 and an outer (second) dielectric layer 154. In at least one embodiment, the outer (second) dielectric layer 154 may enclose at least one portion of the inner (first) dielectric layer 152.

FIGS. 1A, 1B, and 1C show an example embodiment of the antenna 100 with the sleeve portion having two dielectric layers 152 and 154, in accordance with at least one embodiment.

Figure 2:
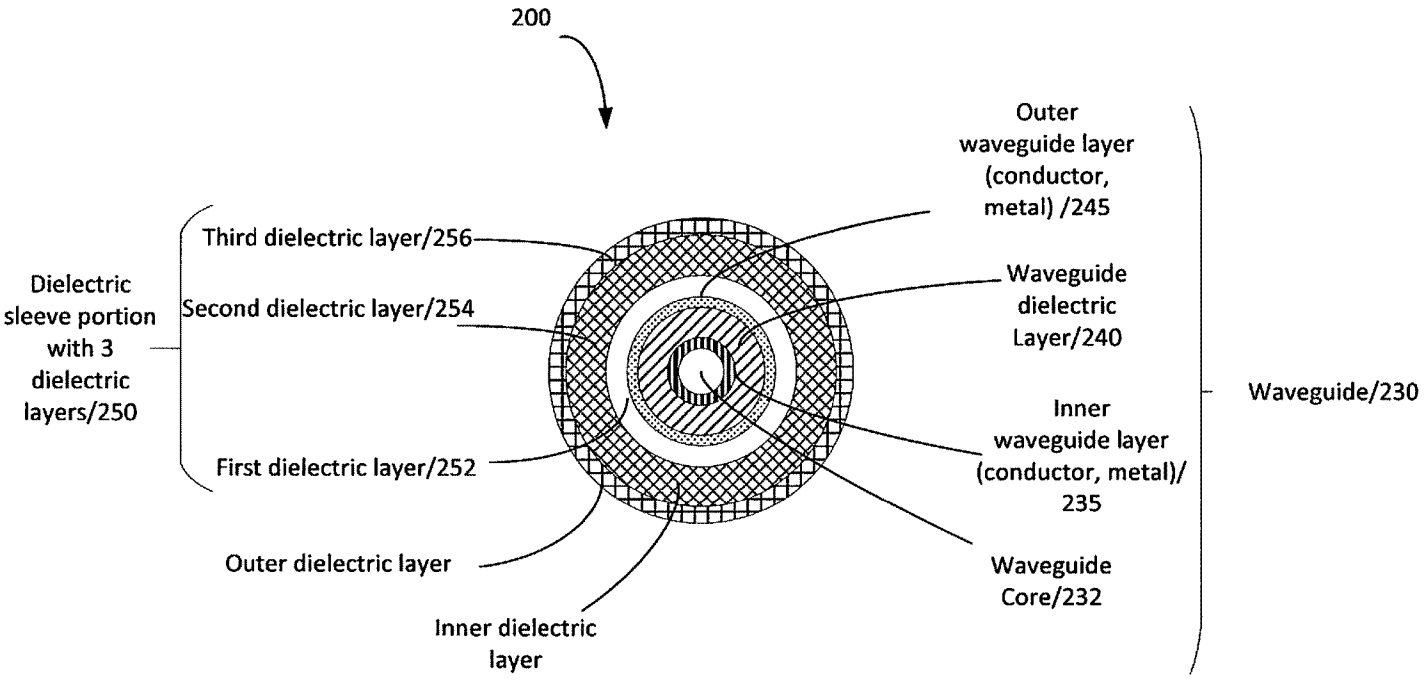
FIG. 2 is a cross-sectional view of another RF antenna for radiating electromagnetic energy when inserted into the reservoir filled with the target material, the antenna having in accordance with at least one embodiment.

FIG. 2 shows a cross-sectional view of the antenna 200 with the dielectric sleeve having three dielectric layers: a first dielectric layer 252, a second dielectric layer 254, and a third dielectric layer 256, in accordance with at least one embodiment.

In at least one embodiment, the dielectric layers of the sleeve portion 150 may be concentric. In at least one embodiment, the dielectric layers of the sleeve portion 150 may be non-concentric. The presence of the non-concentric dielectric layers may assist with achieving an axially asymmetric radiation pattern.

For example, as shown in FIG. 1B, each i-th layer of the sleeve portion 150 may have a radius $R_i$, and a thickness $w_i$. The term "radius" as used herein refers to the inner radius of the layer, as shown in FIG. 1B.

The radius $R_i$ and/or the thickness $w_i$ of at least one dielectric layer of the sleeve portion 150 may be variable or constant along at least one portion of the length of the antenna 100. For example, variation of the radius R, and/or the thickness $w_i$ of the at least one dielectric layer along the length of the dielectric sleeve portion 150, may help to achieve axially asymmetric radiation pattern. The variable thickness and radius of the at least one dielectric layer may be designed to achieve a specific pattern of the radiation intensity along the antenna 100 and/or to achieve axially asymmetric radiation pattern.

The terms "inner dielectric layer" and "outer dielectric layer" are used herein to describe any two dielectric layers of the sleeve portion 150, wherein the "inner dielectric layer" is positioned in closer proximity to the waveguide 130 than the "outer dielectric layer". At any position along the antenna 100, a radius of the "inner dielectric layer" may be smaller than the radius of the "outer dielectric layer".

The term "the most inner dielectric layer" is used herein to describe a layer of the sleeve portion 150, which is the closest to the waveguide 130, that is which has the smallest radius of all dielectric layers of the sleeve portion 150. For example, at FIG. 1C, the most inner dielectric layer is the inner dielectric layer 152. For example, at FIG. 2, the most inner dielectric layer is the first dielectric layer 252.

The term "the most outer dielectric layer" is used herein to describe a layer of the sleeve portion 150, which is the furthest of the waveguide 130, that is which has the largest radius of all dielectric layers of the sleeve portion 150. For example, at FIG. 1C, the most outer dielectric layer is the outer dielectric layer 154. For example, at FIG. 2, the most outer dielectric layer is the third dielectric layer 256.

In at least one embodiment, impedance matching of the antenna 100 to the transmission line 120 may be achieved when a reflection coefficient of the antenna 100 is not greater than about −10 dB. For example, the power reflected from the antenna 100 back to the transmission line 120 may be not greater than about 10%.

In at least one embodiment, the antenna 100 as described herein may not require an impedance matching circuit in order to maximize the power transfer between the feed transmission line 120 and the antenna 100. In at least one embodiment, an input impedance of the antenna 100 may be matched to the impedance of the feed transmission line 120.

In at least one embodiment, the impedance matching (for example, when the reflection coefficient is not greater than about −10 dB) may be achieved at frequencies in a wide impedance matching frequency range. In at least one embodiment, the impedance matching may be achieved when the relative dielectric permittivity of the target material 115 is within the ranges described herein. For example, the impedance matching (for example, when the reflection coefficient is not greater than about −10 dB) may be achieved even when the properties of the target material 115 (e.g. relative dielectric permittivity) are changed. For example, the input impedance of the antenna 100 may remain matched to the feed transmission line 120 over an impedance matching frequency range. For example, the input impedance of the antenna 100 may remain matched to the feed transmission line 120 both when the target material 115 has a first relative dielectric permittivity and when the target material 115 has a second relative dielectric permittivity. For example, the input impedance of the antenna 100 may remain matched to the feed transmission line 120 for a wide range of target materials 115, where the type and/or properties of the target material 115 are as described herein.

For example, the properties of the target material 115 may be changed due to radiation of EM energy, by the antenna 100, into the target material 115. When the properties of the target material 115 change, the input impedance of the antenna 100 may remain matched to the feed transmission line 120.

In at least one embodiment, the input impedance of the antenna 100 may remain matched to the feed transmission line 120 when the antenna 100 radiates into two (or more) different types of target material 115. When the antenna 100 is inserted into the reservoir 110, the input impedance of the antenna 100 may remain matched to the feed transmission line 120 regardless of the type and/or properties of target material 115 in the reservoir 110.

The impedance of the antenna 100 may remain matched to the feed transmission line 120 over the impedance matching frequency range as described herein.

In at least one embodiment, the antenna's input impedance may be matched to the feed transmission line 120 in the presence of a wide range of target material 115 as described herein. In at least one embodiment, the input impedance of the antenna 100 may remain matched to the feed transmission line 120 over a wide frequency range, regardless of the type and/or properties (for example, relative dielectric permittivity) of the target material 115 in the reservoir 110. In at least one embodiment, the antenna 100 may be matched to a broad range of target materials 115 with dielectric and/or electrical properties as described herein. In at least one embodiment, the antenna's input impedance may continue to be matched to the feed transmission line 120 when the properties of the target material 115 change.

In at least one embodiment, the antenna 100 may be adapted to operate at a center frequency of about 30 MHz to about 10 GHz, of about 100 MHz to about 10 GHz, of about 1 GHz to about 3 GHz. For example, the bandwidth of the RF signal may be at least 10% of the center frequency.

In at least one embodiment, the impedance matching frequency range may be about 1 GHz wide, about 1.5 GHz wide, about 2 GHz wide, about 4 GHz wide, about 5 GHz wide. In at least one embodiment, the impedance matching frequency range may be about 2 GHz wide to about 3 GHz wide, about 1.7 GHz wide to about 3 GHz wide, about 1.8 GHz wide to about 3 GHz wide, about 2 GHz wide to about 4 GHz wide, about 2 GHz wide to about 5 GHz wide, about 1.5 GHz wide to about 5 GHz wide.

In at least one embodiment, the impedance matching frequency range may be at least about 2% of the center frequency, at least about 5% of the center frequency, at least about 10% of the center frequency, at least about 20% of the center frequency, at least about 50% of the center frequency.

For example, the impedance of the antenna 100 may be matched to the feed transmission line 120 due to the size and/or distribution of the slots 170.

In at least one embodiment, the slots 170 may be dimensioned (for example, length/height, thickness/width) and positioned (for example, distance between the slots and/or tilt angle) relative to each other such that a reflectivity coefficient of the antenna 100 may be less than about −10 dB.

As a further example, the slots 170 may be positioned and dimensioned such that the reflectivity coefficient of the antenna 100 may be less than about −5 dB.

In at least one embodiment, the thickness and properties (such as, for example, electrical and/or dielectric properties) of the dielectric layers of the sleeve portion 150 may help to achieve the reflection coefficient of the antenna 100 of lower than or about −10 dB.

In at least one embodiment, a combination of the sizes and properties of the dielectric layers of the sleeve portion 150 as well as sizes and shapes of the slots 170 may help to achieve the reflection coefficient of the antenna 100 of about or lower than −10 dB.

In at least one embodiment, the dielectric sleeve portion 150 may stabilize the impedance of the antenna 100 and reduce reflectivity, and therefore reduce the reflection coefficient of the antenna 100 with respect to changes in the properties of the processed target material 115, which surrounds the antenna 100 in the reservoir 110.

In at least one embodiment, the dielectric sleeve portion 150, together with appropriate distribution of slots 170, may form a system that allows for impedance matching over a wide impedance matching frequency range and for various target materials 115.

When RF antennas are designed for communication, the slot distribution and the slot size in such RF communication antennas may be designed to ensure appropriate far field radiation pattern and gain of the antenna 100, including radiation of full power (or at least 90% or at least 95%). The uniformity of radiation in the near field, as well as distribution of the electromagnetic field in the near field is typically not an issue for the RF antennas designed for communications and only a far field pattern is important. Near-field is a concept understood by those skilled in the art.

The antenna 100 as described herein, in at least one embodiment, needs to have a uniform radiation in the near field. Additionally, the antenna 100 needs to have low reflection (less than −10 dB) and full power radiation (or at least 90% or at least 95%). The slot size, slot distribution and slot positions may be designed to ensure all of the three objectives satisfied simultaneously. For example, the distribution of the slots 170 may be designed to ensure approximately uniform radiation intensity in the near field along the length of the antenna 100. The size and the shape of the slots 170 of the antenna 100 may be designed to ensure low disturbance and full radiation of the RF power by the time it reaches the output portion of the antenna 100, and to achieve the uniform radiation in the near field along the length of the antenna 100.

In at least one embodiment, the at least one slot 170 and at least one of the first and the second dielectric layers of the sleeve portion 150 may be dimensioned and/or positioned relative to each other such that the reflectivity coefficient of the antenna may be less than about −10 dB. In at least one embodiment, at least one of the first and the second dielectric layers of the sleeve portion 150 may have permittivity and thickness such that the reflectivity coefficient of the antenna 100 may be not greater than about −10 dB.

The impedance of the antenna 100 may be matched to the feed transmission line 120 due to the size and/or distribution of the slots 170, and/or the thickness and/or electrical or dielectric properties of the sleeve portion 150.

The antenna 100 as disclosed herein may operate in two different modes: (1) a resonant mode and (2) a traveling wave mode. When the wavelength in the target material 115 is longer or approximately equal to the wavelength of the EM wave in the waveguide dielectric layer 140 of the antenna 100, the antenna 100 may operate in the resonant mode. In this mode, a good match of the antenna 100 to the feed transmission line 120 is achieved over a large number of relatively narrow frequency bands. Central frequencies and bandwidths of those frequency bands may be controlled by adjusting the (1) slot distribution and density, (2) thickness of the dielectric layers of the dielectric sleeve portion 150 and (3) the EM properties of the dielectric layers of the dielectric sleeve portion 150.

When the wavelength of the EM wave in the target material 115 is shorter than the wavelength inside the antenna's waveguide dielectric layer 140, the antenna 100 may operate in the traveling mode. In this case, a good match of the antenna 100 to the feed transmission line 120 may be achieved over a single broad impedance matching frequency range. The thickness and the EM properties of the dielectric layers of the sleeve portion 150, as well as design of the slots 170, can affect the bandwidth of the antenna 100 in this case.

To achieve impedance matching for a broad range of target materials 115 (for example, from air to brine), the dielectric sleeve portion 150 and distribution of slots 170 in the antenna 100 may need to be designed such that impedance matching is achieved in both resonant and traveling wave modes.

The permittivity ratio may be calculated as a ratio of a permittivity (dielectric constant) of the target material 115 in the reservoir 110 to the permittivity (dielectric constant) of the waveguide dielectric layer 140.

In at least one embodiment, the antenna 100 may operate in a resonant mode when the permittivity ratio is less than or about 1.0. In at least one embodiment, the antenna 100 may operate in a travelling wave mode when the permittivity ratio is more than about 1.0.

To improve impedance matching of the antenna 100 to the transmission line 120, and to achieve the reflectivity of the antenna 100 of less than or about −10 dB over the impedance matched frequency range for the broadest range of target materials 115 as described herein, the at least two dielectric layers of the sleeve portion 150 may need to have thicknesses and permittivity as described herein.

In at least one embodiment, the thickness $w_i$ of at least one i-th dielectric layer of the dielectric sleeve portion 150 may be a function of a wavelength λ, where λ, is the wavelength of the electromagnetic wave in the waveguide dielectric layer 140.

For example, the thickness of the at least one dielectric layer of the dielectric sleeve portion 150 may be about λ/30 to about λ, about λ/15 to about λ/8, about λ/15 to about λ/4, about λ/30 to about λ/8, about λ/30 to about λ/4.

For example, the thickness of at least one dielectric layer may be approximately equal to a thickness factor k, multiplied by the wavelength of the electromagnetic wave in the dielectric material of the at least one dielectric layer: $w_i = k*\lambda$. For example, the thickness factor k may be about 1/30 (about 0.03333) to about 1, about 1/15 (about 0.06667) to about 1/8 (about 0.125), about 1/15 (about 0.06667) to about 1/4 (about 0.25), about 1/30 (about 0.03333) to about 1/8 (about 0.125), about 1/30 (about 0.03333) to about 1/4 (about 0.25).

In at least one embodiment, the permittivity of the outer dielectric layer 154 of the sleeve portion 150 may be higher than the permittivity of the inner dielectric layer 152. For example, a wavelength of propagation in the outer dielectric layer 154 of the sleeve portion 150 may be shorter than the wavelength of propagation in the inner dielectric layer 152. For example, the permittivity of the outer dielectric layer 154 may be at least 20% higher than the permittivity of the inner dielectric layer 152.

In at least one embodiment, if the sleeve portion has more than two dielectric layers, the permittivity of any outer dielectric layer may be higher than the permittivity of any inner dielectric layer. For example, the permittivity of any outer dielectric layer may be at least 20% higher than the permittivity of any inner dielectric layer.

In at least one embodiment, a ratio of the permittivity of the outer dielectric layer 154 to the permittivity of the inner dielectric layer 152 may be about 2 to about 40, about 5 to about 40. For example, the most inner dielectric layer (152 or 252) may have the lowest permittivity of the dielectric layers of the sleeve portion 150 or 250. For example, the most outer dielectric layer (154 or 256) may have the highest permittivity of the dielectric layers of the sleeve portion 150 or 250.

In at least one embodiment, the most inner dielectric layer 152 or 252 may have the same EM characteristics, such as permittivity and/or conductivity, as the waveguide dielectric layer 140 or 240.

For example, at least one dielectric layer of the sleeve portion 150 may be air. For example, the most inner dielectric layer 152 or 252 may be air.

For example, when one of the dielectric layers is made of air, fixtures such as, e.g., centralizers may be used at the input and output portions the antenna 100 (and/or along the length of the antenna) to provide a certain radius of the dielectric layer made of air. The centralizers may be made of metal and/or dielectric materials.

In at least one embodiment, the permittivity of at least one dielectric layer of the dielectric sleeve portion 150 or 250 may be about 2 to about 20, about 5 to about 10, about 7 to about 20; about 2 to about 40; not greater than about 20; not greater than about 30; not greater than about 40; at least about 1.5; at least about 2; at least about 5; at least about 10. In at least one embodiment, at least one dielectric layer of the dielectric sleeve portion 150 (or 250) may be in immediate contact with the outer waveguide layer 145 (or 245) of the antenna 100.

For example, at least one dielectric layer of the dielectric sleeve portion 150 may be made of Teflon (PTEE), PEEK, fiberglass, glass, and/or different types of ceramics, such as, for example and not limited to, Alumina, Zirconia.

It should be understood that various other combinations of thicknesses and EM parameters of dielectric layers of the dielectric sleeve portion 150 may be used, especially if the antenna 100 is expected to operate in respect of a limited range of target materials 115.

When the target material 115 of the reservoir 110 is heated by the antenna 100, the antenna 100 may be in a direct contact with the heated target material 115, which may contain various liquids, sand grains, mud, steam etc. In at least one embodiment, the dielectric sleeve portion 150 may also protect the antenna 100 from the target material 115 in the reservoir 110. The most outer dielectric layer 154 (or 256) of the dielectric sleeve portion 150 (or 250) may need to seal the internal structure of the antenna 100 (or 200) and to protect it from the influence of target material 115 and processed target material 115 that are contained in the reservoir 110.

In at least one embodiment, the sleeve portion 150 may be made of the material that can tolerate temperature of about 300 degrees C. In at least one embodiment, the sleeve portion 150 may be made of the material that can tolerate temperature of about 100 degrees C.; of about 200 degrees C.; of about 300 degrees C.; of about 500 degrees C.; of about 1000 degrees C. In at least one embodiment, at least one of the dielectric layers of the dielectric sleeve portion 150 may be made at least in part of ceramic material. For example, the most outer dielectric layer 154 of the sleeve portion 150 may be made of ceramic material. For example, the ceramic material may withstand temperature as high as 1000 C and more and seal the internal structure of the antenna 100 from the influence of processed target material 115, or various target materials 115, that is/are contained in the reservoir 110. For example, the ceramic material may withstand steam.

In at least one embodiment, the length of the antenna 100 may be at least about two wavelengths of the EM wave inside the waveguide dielectric layer 140. For example, the antenna 100 may be long enough such that more than 80% of the RF power that passed through the input portion 190 of the waveguide 130, may be radiated before the EM wave (power) reaches the output portion 192 of the waveguide 130.

Referring again to FIG. 1A, in at least one embodiment, the antenna 100 may comprise a termination 184. For example, the output portion 192 of the waveguide 130 may be operatively connected to the termination 184. In at least one embodiment, the termination 184 may be short (voltage forced to zero), open (current forced to zero), or a matched termination (matched load termination). In at least one embodiment, the matched termination may be made of a matching load, which may absorb all the remaining RF power that reached the output portion 192 of the waveguide 130.

For example, the antenna 100 may radiate almost all of the EM power before the EM wave reaches the output portion 192 of the waveguide 130. In this case, the type of the termination 184 may not be important. For example, such operation mode may be possible in an example embodiment where the length of the antenna 100 is many wavelengths of the EM wave inside the waveguide dielectric layer 140 of the antenna 100.

In some exemplary embodiments, a small but significant portion of the EM power may reach the output portion 192 of the waveguide 130. In that case, the termination 184 may be important for the overall performance of the antenna 100. For example, a short termination 192 may reflect the EM wave with a reflection coefficient of −1. For example, an open termination 192 may reflect the EM wave with +1 reflection coefficient.

A matched termination (matched load termination) may not reflect anything, but may absorb all the EM power instead. In this case, the output portion 192 of the waveguide 130 may get heated at a rate that may be proportional to the EM power reaching it.

In at least one embodiment, the antenna 100 may have the same cross-sectional dimensions as the feed transmission line 120. For example, the diameter of the waveguide 130 may be approximately equal to the diameter of the feed transmission line 120. For example, the shape of the cross-section of the waveguide 130 may be the same as the shape of the feed transmission line 120. In at least one embodiment, the antenna 100 may have the waveguide 130 of the same type as the feed transmission line 120.

In at least one embodiment, the waveguide 130 of the antenna 100 may have the shape and/or the cross-sectional dimensions and/or the type different from the shape and/or cross-sectional dimensions and/or the type of the feed transmission line 120. In this case, an adaptor which may comprise a connecting transmission line may be used to connect the feed transmission line 120 and the antenna 100.

In at least one embodiment, the cross-sectional size of the feed transmission line 120 may be larger than the cross-sectional size of the waveguide 130 and/or antenna 100. In this case, a transition and/or adaptor may need to be used.

In at least one embodiment, the adapter may be a two port device, with a first port having the cross-sectional size and shape of the feed transmission line 120, and a second port having the cross-sectional size and shape of the waveguide 130. For example, the first port of the adapter may be operatively connected to the feed transmission line 120 and the second port of the adapter may be operatively connected to the input portion of the waveguide 190.

In at least one embodiment, the purpose of the adaptor may be to guide the EM wave from the feed transmission line 120 to the waveguide 130 with minimal reflection. For example, the reflection of less than −20 dB, i.e. the power reflection of less than 1%, may be required.

For example, the connecting transmission line may have a form of a tapered transition, a step transition, a quarter-wavelength transformer, or a combination thereof. For example, other types of the connecting transmission line may be used.

For example, if the system operates at an industrial frequency of 2.45 GHz, the feed transmission line 120 may be a WR-340 rectangular waveguide, while the antenna's waveguide 130 may be made of a 1⅝" air-filled coaxial cable. In that case, a waveguide to coax adapter (WR-340 to EIA 1⅝") may need to be used to connect the antenna 100 to the feed transmission line 120.

For example, in between of the first and the second port, a tapered coaxial cable may be used with the outer conductor being a truncated cone with lower radius and larger radius. For example, the adapter may be a step transition, i.e. a coax with a radius between $r_1$ and $r_2$, such that its characteristic impedance ($Z_3$) satisfies $Z_3$=sqrt($Z_1$*$Z_2$), where $Z_1$ and $Z_2$ are characteristic impedances of the coax 1 and 2, respectively. The length of the transition coax may be a quarter of the wavelength.

For example, the adapter may have one or more steps. It should be noted that the adapter may have other designs.

In at least one embodiment, the antenna 100 may further comprise a flange 180 and/or a feed choke 182, positioned at the input portion of the waveguide 130. For example, the flange 180 and/or a thread may be used to connect the antenna 100 with the feed transmission line 120 or the connecting transmission line.

In at least one embodiment, no choke may be required to stop the leakage current from propagating along the outer walls of the feed transmission line 120.

Referring back to FIGS. 1A, 1B, and 1C, in at least one embodiment, an RF choke 182 may be used to stop the leakage current from propagating along the outer walls of the feed transmission line 120. In at least one embodiment, a metal plate with a λ/2 (λ is the wavelength of the radiated EM wave) or larger diameter may be used.

Suppressing the leakage current may be especially important when the surrounding target material 115 is lossless or has a very low electrical loss, or when the target materials is expected to have very low electrical loss at some point during the operation of the antenna 100. In at least one embodiment, the choke 182, or the metal plate, may be positioned either on the feed transmission line 120 or on the antenna 100, for example, on the antenna's side of the flange 180 or of another connection used. In at least one embodiment, the choke 182 or the metal plate may be positioned closer to the feed transmission line 120 than the closest slot 170. In at least one embodiment, the antenna 100 may have no choke.

In at least one embodiment, the antenna 100 may operate as a monopole antenna if at least one portion of the reservoir 110 is made of a conductor (e.g. a metal) which acts as a ground plane. In such example of embodiment, the antenna 100 may not need a choke 182.

In at least one embodiment, the antenna 100 may comprise a plurality of segments. This may help to manufacture and to assemble the antenna 100.

Operation of Exemplary Implementations

In a first operational example, an antenna 100 with an a coaxial waveguide 130 with the waveguide dielectric layer 140 filled with air with a radius of the inner waveguide layer (135) of about 9.53 mm and a radius of the outer waveguide layer (145) of about 20.4 mm was analyzed in frequency range of 0 to 3 GHz. The length of the antenna (100) was about 560 mm, which corresponded to approximately 5.6 wavelengths at about 3 GHz. The antenna was terminated with a short circuit. The antenna's dielectric sleeve portion 150 had two ¼"-thick, cylindrical, concentric dielectric layers. The inner dielectric layer 152 (the layer immediately next to the waveguide) was air, while the outer dielectric layer 154 was alumina.

Figure 7:
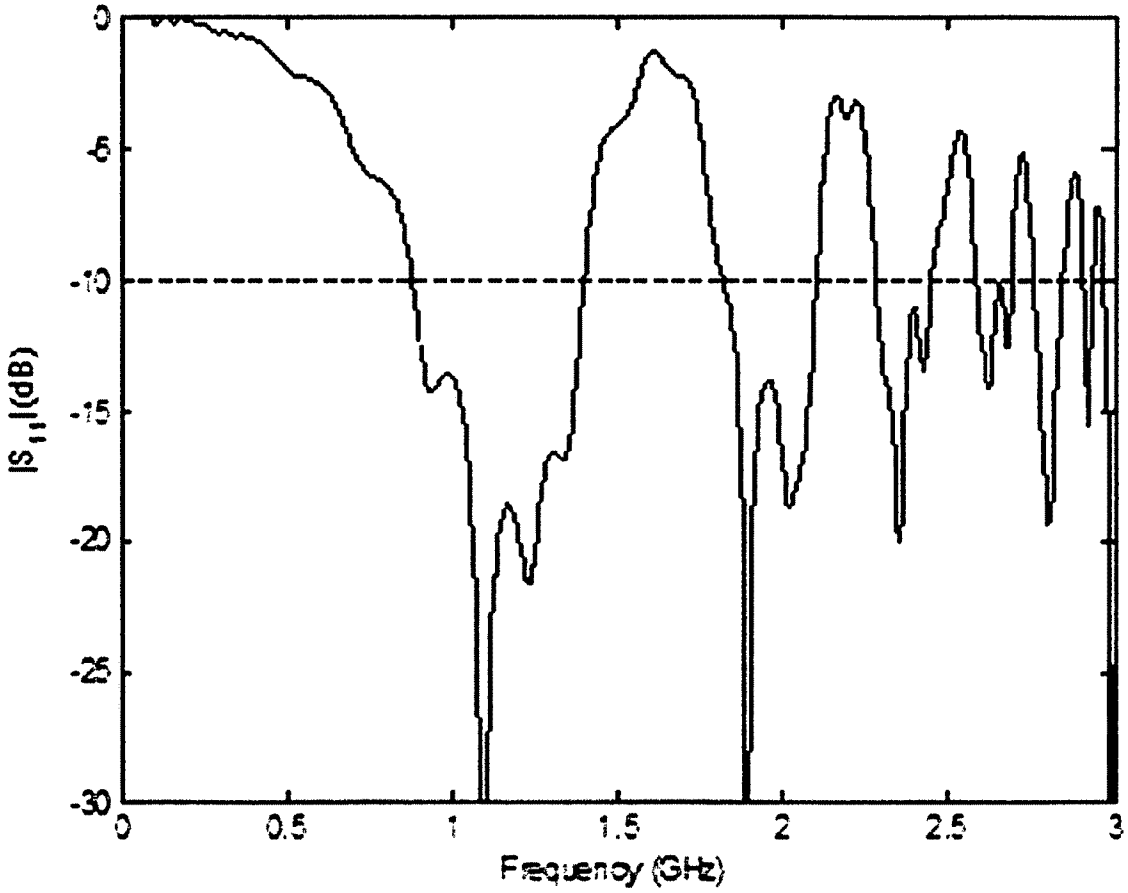
FIG. 7 is a reflection coefficient of the RF antenna operating in air in a resonant mode, in accordance with at least one embodiment.

FIG. 7 shows the reflection coefficient of this antenna 100 during operation in the case where the target material 115 in the reservoir 110 is air. In this example implementation, the antenna 100 was operating in a resonant mode. The exemplary reflection coefficient of the antenna 100 as shown at FIG. 7 was calculated and the values of the reflection coefficient as shown at FIG. 7 were confirmed experimentally.

Figure 8:
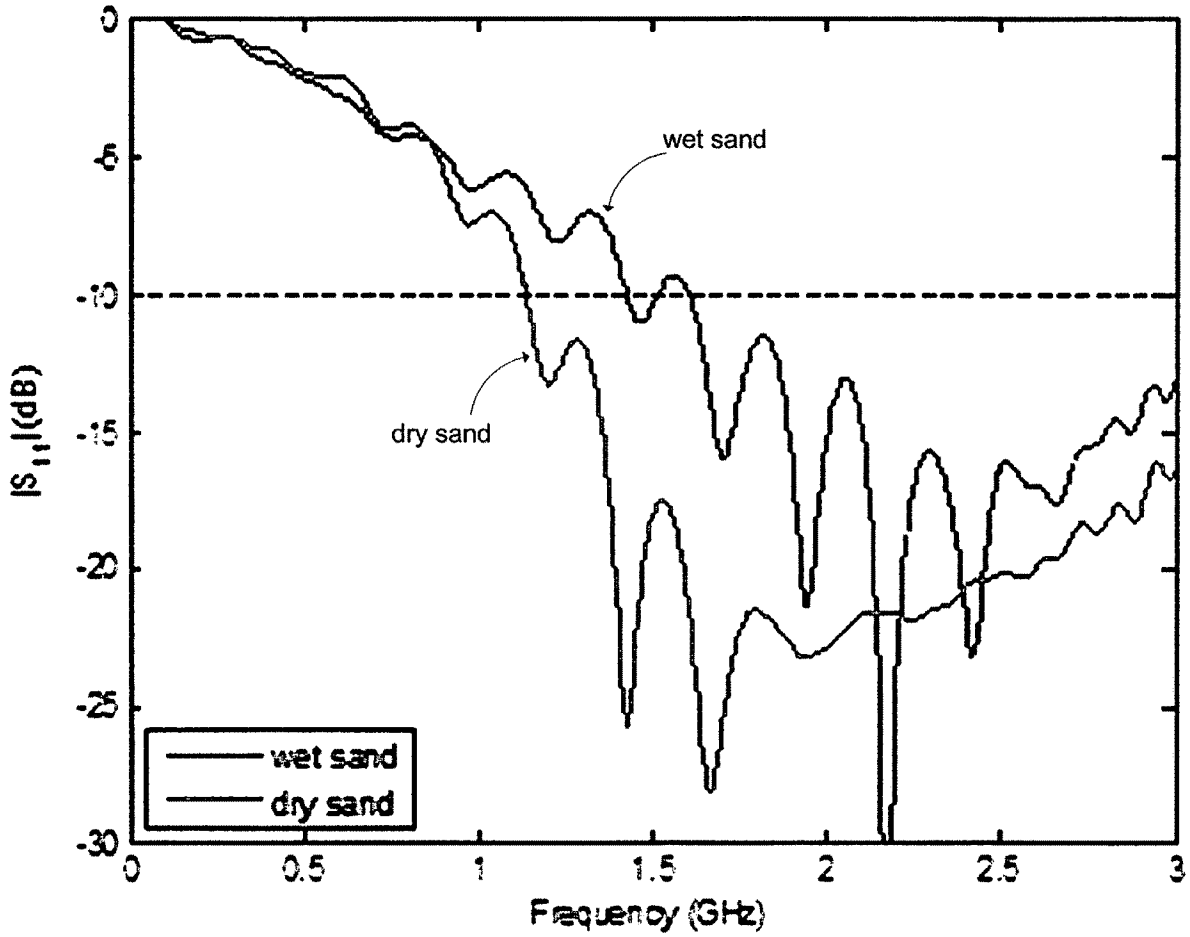
FIG. 8 shows reflection coefficients of the RF antenna operating in wet sand ($\varepsilon_r$=57, $\sigma$=1.75 S/m) and dry sand ($\varepsilon_r$=5, $\sigma$=2E−5 S/m), while operating in a travelling mode, in accordance with at least on embodiment.

FIG. 8 shows relative reflection coefficients of the antenna 100 during operation in traveling wave mode in the case of two different target materials 115, namely wet sands (solid line) and dry sands (dashed line), in accordance with at least one embodiment. The permittivity $\varepsilon_r$ of the wet sands (solid line) was assumed to be about 57, while dielectric conductivity σ was assumed to be about 1.75 S/m. The permittivity $\varepsilon_r$ and dielectric conductivity σ of the dry sands (dashed line) were assumed to be about 5 and about 2E−5 S/m, respectively.

The reflection coefficient of the antenna 100 operating in sands with various degrees of moisture may be expected to fall between the solid and dashed lines shown in FIG. 8. In at least one embodiment, a reflection of −10 dB and lower (10% of power and lower) may be acceptably low reflection.

FIGS. 7 and 8 together illustrate that the antenna 100 may be acceptably matched regardless of whether it is utilized in respect of air or wet sand, and/or dry sand, and/or any target material 115 having a relative permittivity of about 5 to about 57.

Figure 9:
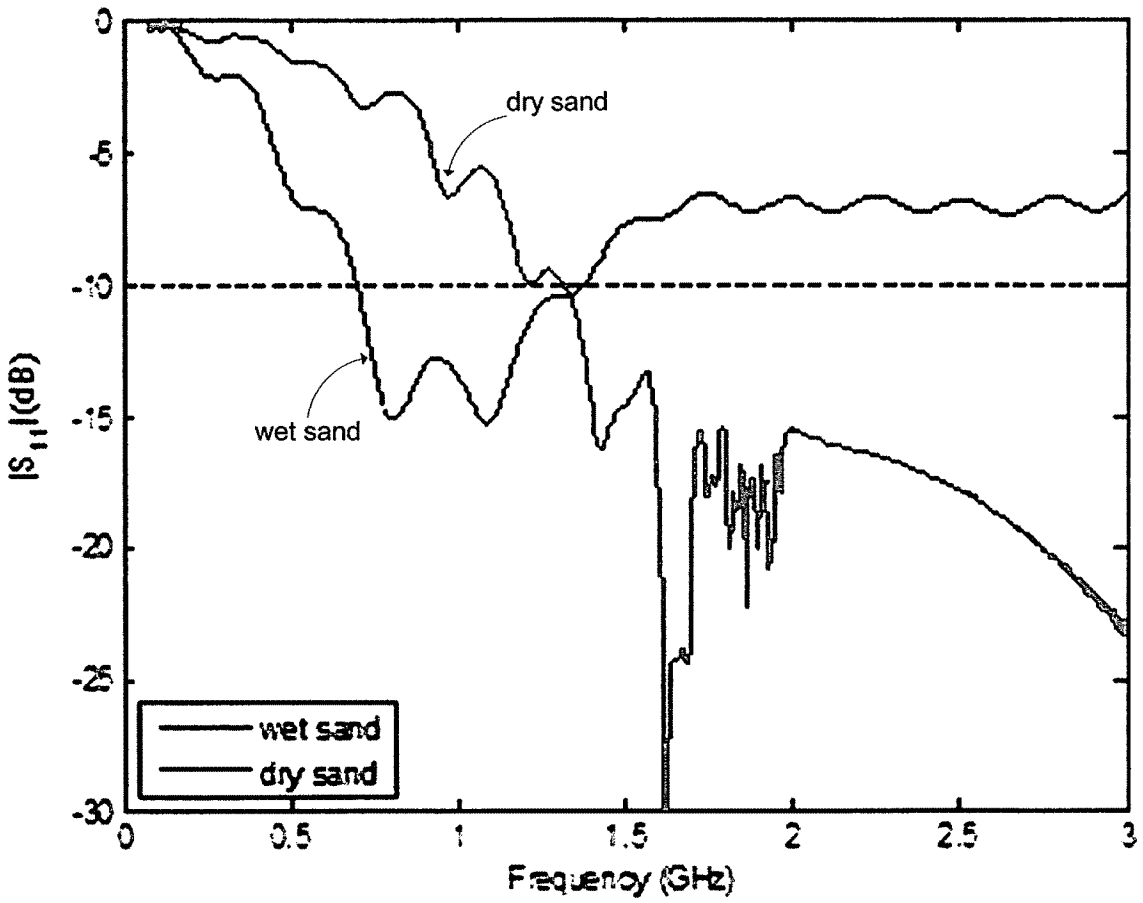
FIG. 9 shows reflection coefficients of the RF antenna without the dielectric sleeve portion in wet sand ($\varepsilon_r$=57, $\sigma$=1.75 S/m) and dry sand ($\varepsilon_r$=5, $\sigma$=2E−5 S/m).

For comparison, FIG. 9 shows reflection coefficients of a traditional antenna without the dielectric sleeve portion 150 applied to wet (solid line) and dry (dashed line) sands. This example clearly shows that it is not possible to achieve a reflection coefficient of lower than −10 dB over a wide frequency range (e.g. wider than at least about 0.5 GHz) with a traditional antenna without dielectric sleeve portion 150 when the target material 115 has a relative permittivity of about 5 to about 57.

A number of embodiments have been described herein. However, it will be understood by persons skilled in the art that other variants and modifications may be made without departing from the scope of the embodiments as defined in the claims appended hereto.

The invention claimed is:

1. A radio frequency antenna for radiating electromagnetic energy into a reservoir filled with a target material, the antenna being operatively connected to a feed transmission line, the antenna comprising:

a waveguide having a waveguide dielectric layer and an outer waveguide layer at least partially surrounding the waveguide dielectric layer, the outer waveguide layer defining at least one slot for radiating the electromagnetic energy into the reservoir;

and a sleeve portion surrounding at least a portion of the waveguide, the sleeve portion having at least first and second dielectric layers, the second dielectric layer at least partially surrounding the first dielectric layer, where the permittivity of the second dielectric layer is higher than the permittivity of the first dielectric layer and the first dielectric layer is positioned in closer proximity to the waveguide than the second dielectric layer;

such that when the antenna is inserted into the reservoir, the input impedance of the antenna remains matched to the feed transmission line for a wide range of target materials.

2. The radio frequency antenna of claim 1, wherein the at least one slot and at least one of the first and second dielectric layers are dimensioned and positioned relative to each other such that the reflectivity coefficient of the antenna is less than approximately −10 dB.

3. The radio frequency antenna of claim 1, wherein at least one of the first and second dielectric layers have permittivity and thickness such that the reflectivity coefficient of the antenna is less than approximately −10 dB.

4. The radio frequency antenna of claim 1, wherein the thickness of at least one of the first and second dielectric layers is equal to a thickness factor multiplied by the wavelength of the electromagnetic wave in the waveguide dielectric layer, the thickness factor being in the approximate range of 1/15 to 1/4.

5. The radio frequency antenna of claim 1, wherein the thickness of at least one of the first and second dielectric layers is equal to a thickness factor multiplied by the wavelength of the electromagnetic wave in the waveguide dielectric layer, the thickness factor being in the approximate range of 1/30 to 1.

6. The radio frequency antenna of claim 1, wherein the radius of the at least first and second dielectric layers is variable along the length of the antenna.

7. The radio frequency antenna of claim 1, wherein a most inner dielectric layer of the sleeve portion is air.

8. The radio frequency antenna of claim 1, wherein at least one of the at least first and second dielectric layers is made at least in part of ceramic material.

9. The radio frequency antenna of claim 1, wherein at least one of the first and second dielectric layers are concentric.

10. The radio frequency antenna of claim 1, wherein the at least one slot has a helical form.

11. The radio frequency antenna of claim 1, wherein the outer waveguide layer defines a plurality of slots.

12. The radio frequency antenna of claim 11 where the cuter waveguide defines the slots along the length of the waveguide with dimensions and relative distribution such that uniform near-field radiation is provided along the length of the antenna.

13. The radio frequency antenna of claim 11, wherein each of the plurality of slots are formed with identical dimensions.

14. The radio frequency antenna of claim 11, wherein each of the plurality of slots have identical shapes.

15. The radio frequency antenna of claim 11, wherein the slots are equally distributed along the length of the waveguide.

16. The radio frequency antenna of claim 11, wherein the slots are unequally distributed along the length of the waveguide.

17. The radio frequency antenna of claim 11, wherein the waveguide has an input portion operatively connected to the feed transmission line and an output portion connected to a termination.

18. The radio frequency antenna of claim 17, wherein the slots that are in closer proximity to the input portion of the waveguide have smaller dimensions and are positioned farther apart than slots that are in closer proximity to the output portion of the waveguide.

19. The radio frequency antenna of claim 1, wherein the antenna is adapted to operate:

(a) in a resonant mode when a permittivity ratio is less than or about 1 and (b) in a travelling wave mode when the permittivity ratio is more than about 1, wherein the permittivity ratio is the ratio of a permittivity of the target material in the reservoir to the permittivity of the waveguide dielectric layer.

20. The radio frequency antenna of claim 1, wherein the waveguide is of the type selected from the group consisting of: a coaxial waveguide, a hollow cylindrical waveguide and a rectangular waveguide.

21. The radio frequency antenna of claim 1, wherein the lateral dimension of the waveguide is approximately equal to the lateral dimension of the feed transmission line.

22. The radio frequency antenna of claim 1, wherein the feed transmission line and the waveguide are both coaxial cables.

23. The radio frequency antenna of claim 1, adapted to operate at a center frequency of about 30 MHz to about 10 GHz.

24. The radio frequency antenna of claim 1, wherein the waveguide dielectric layer is air.

25. The radio frequency antenna of claim 1, wherein the antenna comprises a plurality of segments.

26. The radio frequency antenna of claim 1, wherein a termination of the radio-frequency antenna is selected from the group consisting of, a short termination, an open termination, and a matched termination.

27. The radio frequency antenna of claim 1, further comprising a connecting transmission line operatively connected between the antenna and the feed transmission line.

28. The radio frequency antenna of claim 1, wherein the target material in the reservoir is selected from the group consisting of: air, dry oil sand, wet oil sand, water, soil, soil sands, shale, ore, and a combination thereof.

29. The radio frequency antenna of claim 1, wherein the target material in the reservoir has a relative dielectric permittivity about 1 to about 90 and electric conductivity about 0 S/m to about 5 S/m.

30. The radio frequency antenna of claim 1, wherein at least one portion of the antenna is inserted into the reservoir or at least one portion of the antenna is outside of the reservoir.

31. The radio frequency antenna of claim 1 further comprising an inner waveguide layer at least partially surrounded by the waveguide dielectric layer.

* * * * *